US011247113B2

(12) United States Patent
Colling

(10) Patent No.: US 11,247,113 B2
(45) Date of Patent: Feb. 15, 2022

(54) TRAMPOLINE WITH HANDRAIL

(71) Applicant: Skywalker Holdings, LLC, Brigham City, UT (US)

(72) Inventor: Michael J. Colling, Bringham City, UT (US)

(73) Assignee: Skywalker Holdings, LLC, Brigham City, UT (US)

( * ) Notice: Subject to any disclaimer, the term of this patent is extended or adjusted under 35 U.S.C. 154(b) by 0 days.

(21) Appl. No.: 16/294,779

(22) Filed: Mar. 6, 2019

(65) Prior Publication Data

US 2020/0282285 A1 Sep. 10, 2020

(51) Int. Cl.
*A63B 5/11* (2006.01)
*A63B 71/02* (2006.01)

(52) U.S. Cl.
CPC ..... *A63B 71/022* (2013.01); *A63B 5/11* (2013.01)

(58) Field of Classification Search
CPC ..... A63B 5/11; A63B 5/00; A63B 21/026; A63B 21/0557; A63B 71/022; Y10T 403/4309; Y10T 403/42
See application file for complete search history.

(56) References Cited

U.S. PATENT DOCUMENTS 8,012,066 B1 * 9/2011 Hsiang ..... A63B 71/022
9,682,264 B1 6/2017 Chen
2010/0240496 A1 * 9/2010 Chen ..... A63B 5/11 482/27
2012/0252634 A1 * 10/2012 Ikegami ..... A63B 71/0054 482/29
2017/0312563 A1 * 11/2017 Chen ..... A63B 5/11
2018/0093119 A1 * 4/2018 Hsiang ..... A63B 71/023
2018/0093120 A1 * 4/2018 Chen ..... A63B 71/023
(Continued)

FOREIGN PATENT DOCUMENTS

CA 2223301 * 6/1999 ..... A63B 21/4035
CN 201739282 U 2/2011
(Continued)

OTHER PUBLICATIONS (Debra. Review of Skywalker Trampolines Mini Trampoline with Enclosure Net, by Skywalker Trampolines Store. Amazon, May 17, 2015, https://www.amazon.com/Skywalker-Trampolines-Space-Explorer-Trampoline/dp/B07NSTQ13B/ref=sr_1_2?dchild=1&keywords=skywalker%2Btrampoline%2Bmini&qid=1603315222&sr=8-2&th=1) (Year: 2015).*
(Continued)

*Primary Examiner* — Jennifer Robertson
*Assistant Examiner* — Catrina A Letterman
(74) *Attorney, Agent, or Firm* — Alliance IP, LLC

(57) ABSTRACT

A trampoline frame includes a bottom ring frame to couple to a jumping surface, a plurality of legs coupled to the bottom ring, a plurality of curved upright supports coupled to the bottom ring, and a handrail coupled to the upright supports. The curved upright supports attach to and support a flexible wall to form a barrier around at least a portion of the jumping surface. Each of the plurality of legs is curved to place a corresponding foot of the leg outside an external perimeter of the bottom ring frame when connected to the bottom ring frame. Each of the plurality of curved upright supports is curved inward toward a center of the jumping surface to connect to the handrail.

18 Claims, 11 Drawing Sheets

(56) References Cited

U.S. PATENT DOCUMENTS

| | | | | |
|---|---|---|---|---|
| 2018/0236343 | A1* | 8/2018 | Chen | A63B 71/022 |
| 2018/0290000 | A1* | 10/2018 | Chen | A63B 71/04 |
| 2018/0369629 | A1* | 12/2018 | Publicover | A63B 5/11 |
| 2019/0060692 | A1 | 2/2019 | Chang et al. | |
| 2019/0105523 | A1* | 4/2019 | Liu | A63B 5/11 |

FOREIGN PATENT DOCUMENTS

| | | | |
|---|---|---|---|
| CN | 102000411 | A | 4/2011 |
| CN | 103432709 | A | 12/2013 |
| CN | 204193382 | U | 3/2015 |

OTHER PUBLICATIONS

Skywalker Trampolines. (2016). Seaside Adventure Bouncer: Assembly, Maintenance, and User Manual. China: Skywalker Holdings, LLC. (Year: 2016).*

PCT International Search Report and Written Opinion issued in PCT/US2020/021384, dated Jun. 12, 2020; 17 pages.

Skywalker Trampolines, "Skywalker Trampolines Mini Trampoline Assembly Video," Dec. 20, 2019. Retrieved from the internet on Apr. 27, 2020, at URL: https://www.youtube.com/watch?v=TBefVqjp8GY (5 pages).

* cited by examiner

TRAMPOLINE WITH HANDRAIL

BACKGROUND

The present disclosure relates in general to the field of recreational equipment, and more specifically, to an improved trampoline frame.

Trampolines are popular exercise devices in both recreational and fitness contexts. A conventional trampoline includes a flexible bed which is supported off the ground by a substantially rigid frame. A number of springs extend between the frame and the bed such that the bed produces a bouncing effect when an individual jumps thereon. Over time, early trampoline models developed a reputation as posing an injury risk. For instance, injuries may result from the user coming into contact with the rigid frame or due to a fall from the elevated jumping surface. In one attempt to address such issues, enclosure systems have been developed and implemented in modern trampoline designs, such as through netting encircling the jumping surface to prevent an individual from falling from the trampoline or coming into contact with rigid objects outside of or on the periphery of the trampoline, among other examples.

BRIEF DESCRIPTION OF THE DRAWINGS

Like reference numbers and designations in the various drawings indicate like elements.

DETAILED DESCRIPTION

While many trampolines are designed to maximize the area of the jumping surface, in some instances, it may be desirable to provide for trampoline designs which are adapted for users, who may be less confident in their balance or jumping abilities, such as young children and even some less adept or experienced adult users. It may be desirable, in such designs, to provide a handlebar or other support, which a user may utilize to stabilize and otherwise assist the user while on the jumping surface of the trampoline.

Figure 1:
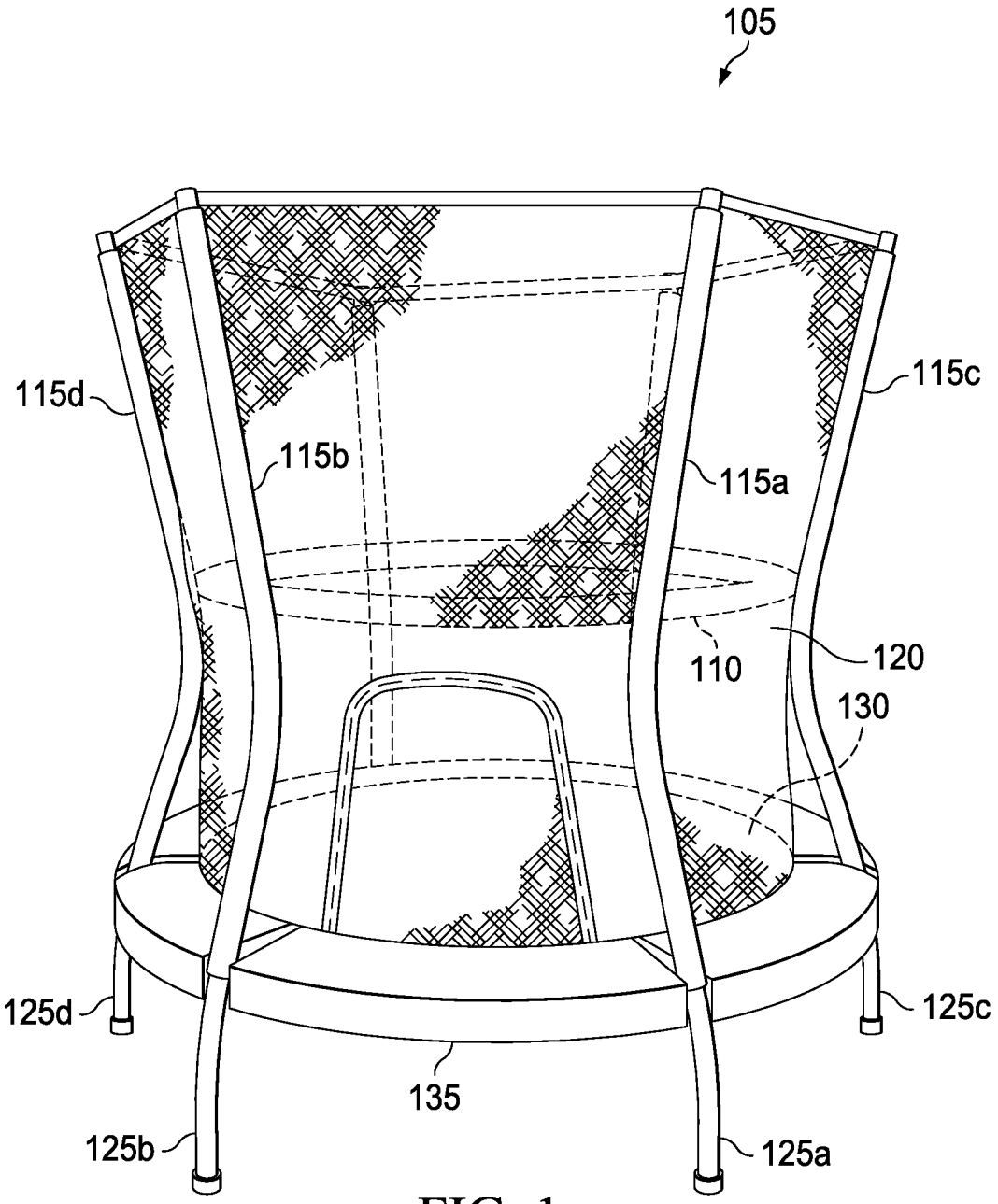
FIG. 1 illustrates an example trampoline with a handrail in accordance with at least some embodiments.

FIG. 1 illustrates an example implementation of a trampoline 105 including a handlebar 110 (also referred to herein, alternatively, as a "handrail"). In this particular example, the trampoline has dimensions adapted for use by a single user. In the example of FIG. 1, an example trampoline 105 incorporating a handlebar 110 may include upright supports (e.g., 115*a-d*) to which a flexible wall (e.g., 120) may be attached and supported. The flexible wall 120 may be constructed of a flexible fabric, netting, or other flexible material, to prevent a user of the trampoline from falling from the elevated jumping surface 130 of the trampoline. The upright supports (e.g., 115*a-d*) may be connected to a base frame 135 of the trampoline (e.g., a ring frame covered in padding), which may be coupled to a jumping surface 130. The bottom of the flexible wall 120, in some implementations, may be attached to at least a portion of the (outer edge) of the jumping surface 130. Springs (e.g., coiled springs, spring rods, leaf springs, elastic cords, elastic loop with ball, etc.) may be used to couple the base frame 135 to the jumping surface 130.

Figure 2B:
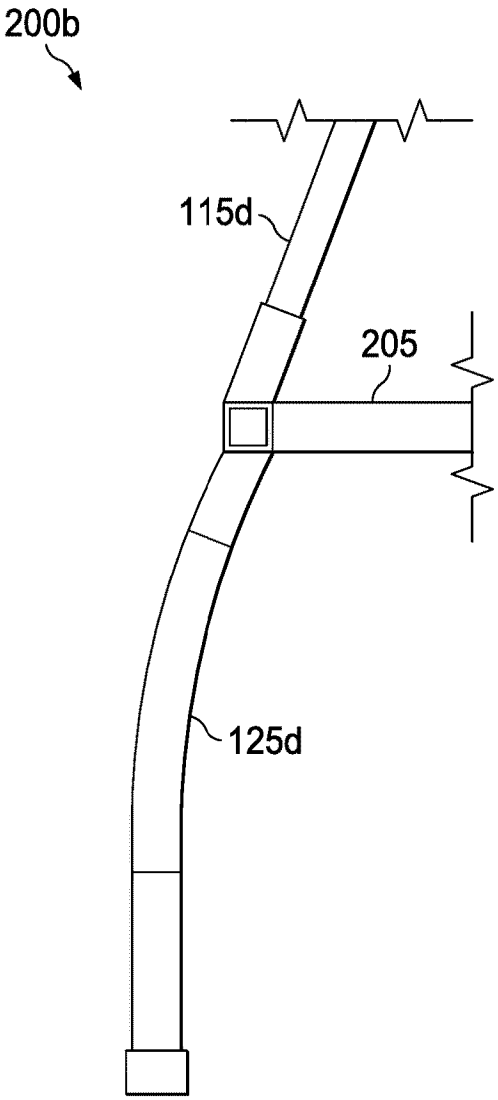
FIG. 2A-2B illustrate details of an example leg of a frame of a trampoline in accordance with at least some embodiments.
Figure 2A:
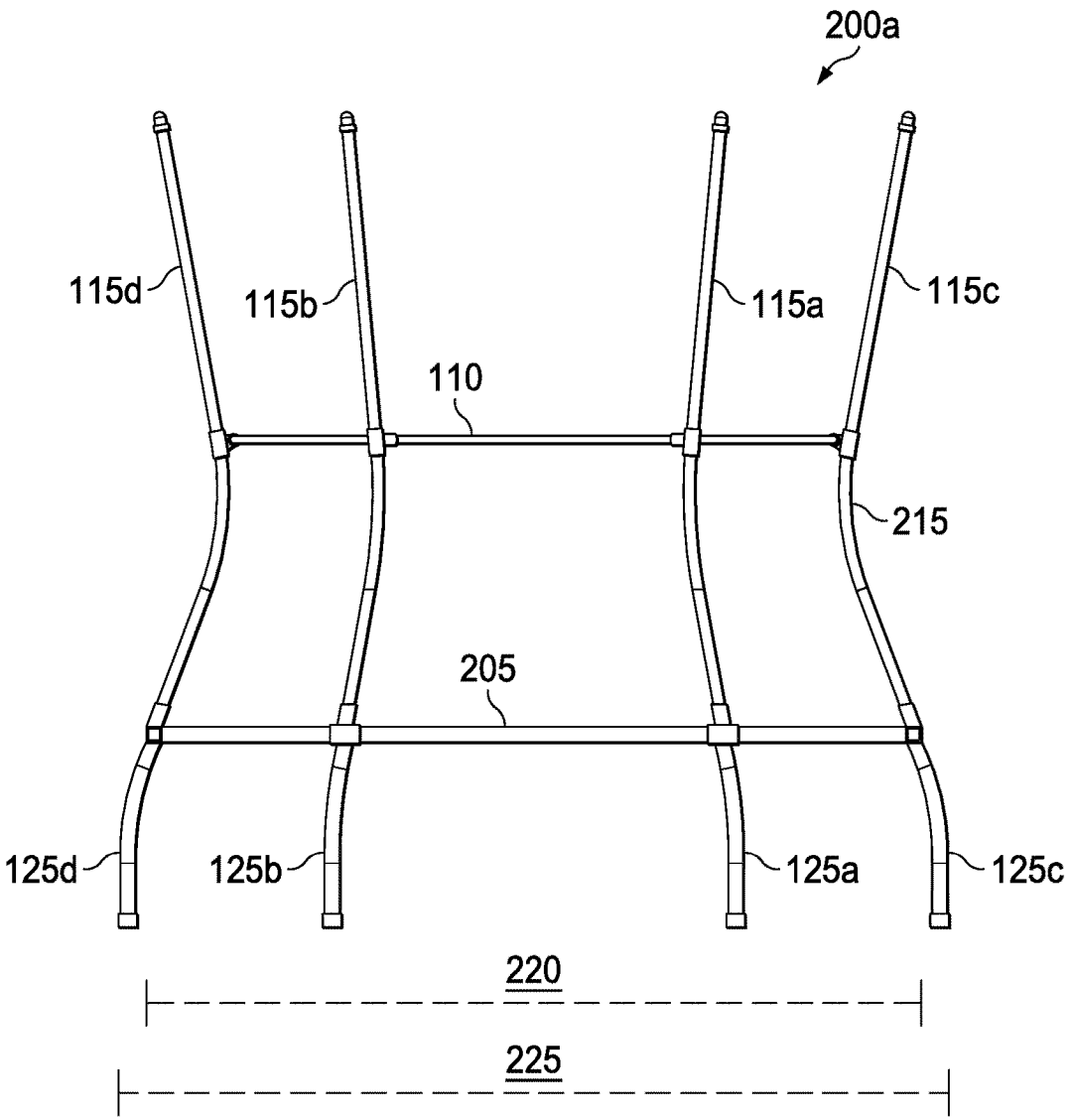

In some implementations, upright supports (e.g., 115*a-d*) may be curved so as to form a vertical, hourglass-shaped frame, where the middle portion of the upright supports (e.g., 115*a-d*) curve inward toward the center of the jumping surface 130 and to which the handlebar 110 is to be connected. Among other example advantages, an hourglass frame may facilitate placement of a handlebar 110 better aligned with the jumping surface 130, while enabling a wider trampoline base that is less prone to tipping or imbalance. To further encourage such geometry, in some implementations, legs or other supports (e.g., 125*a-d*) may be provided, which are curved to contact the ground (and support the remaining trampoline) outside the perimeter of the remaining trampoline structure 105, allowing an even broader base and lower center of gravity for the trampoline. Turning to FIG. 2A, a side view 200*a* of an example trampoline frame is shown, which includes a handlebar 110 as part of the frame. The frame may be constructed of rigid materials, such as galvanized or powder coated steel or other materials with suitable strength. To enhance the safety of the trampoline frame, portions of the frame (e.g., the upright supports 115*a-d*, bottom ring frame section 205, etc.) be wrapped in protective padding, including the handlebar 110 (such as shown in FIG. 1).

As illustrated in the example of FIG. 2A, a trampoline frame may include a bottom ring frame section 205, which attaches (e.g., through springs) to the jumping surface and forms a plane parallel to (e.g., coplanar with or parallel to and above or below) the plane of the jumping surface 130. Leg sections (e.g., 125*a-d*) may connect to the bottom ring frame section 205 to elevate the bottom ring frame 205 and the jumping surface 130 above the ground, with the feet (or bottoms) of the leg sections (e.g., 125*a-d*) curved or flared to contact the ground outside the perimeter 220 of the bottom ring frame section 205. FIG. 2B provides a close-up view 200*b* of an example curved leg section (e.g., 125*d*) connecting to a bottom ring frame section 205.

Returning to the discussion of FIG. 2A, upright support frame sections (e.g., 115*a-d*) may also connect to the bottom ring frame 205. The upright supports (e.g., 115*a-d*), in some implementations, may be configured to curve inward, toward the center or middle of the jumping surface 130. The upright supports may support a flexible wall 120, which may be hung, connected, or otherwise attached to the upright supports (e.g., 115*a-d*). For instance, upright support connection caps (e.g., 210*a-d*) may be provided, which attach to the tops of the upright supports and act to fix connectors (e.g., loops, rings, pins, etc.) of the flexible wall 120 to the upright supports (e.g., 115*a-d*). In addition to supporting a flexible wall, upright supports (e.g., 115*a-d*) may also connect to and support a handrail section 110. The handrail section 110 may connect to three or more of the upright supports (e.g., 115*a-d*) along an inward-curved section (e.g., 215) of the respective upright support (e.g., 115*a*). As a result, in such examples, the handrail 110 may have dimensions (e.g., 225) that fit within the perimeter 220 defined by the dimensions of the bottom ring frame section 205. For instance, in circular trampoline implementations, both the bottom ring frame 205 and handrail 110 may be circular in geometry, with the diameter of the bottom ring frame 205 being greater than the diameter of the circular handlebar section 110. Likewise, in a rectangular trampoline implementation, the length and width of the bottom (rectangular) ring frame may be greater than the corresponding length and width of the handlebar section 110, and so on (i.e., with similar principles governing the relative measurement of the ring frame and handlebar in implementations according to other geometries (e.g., oval trampolines), etc.).

Figure 3:
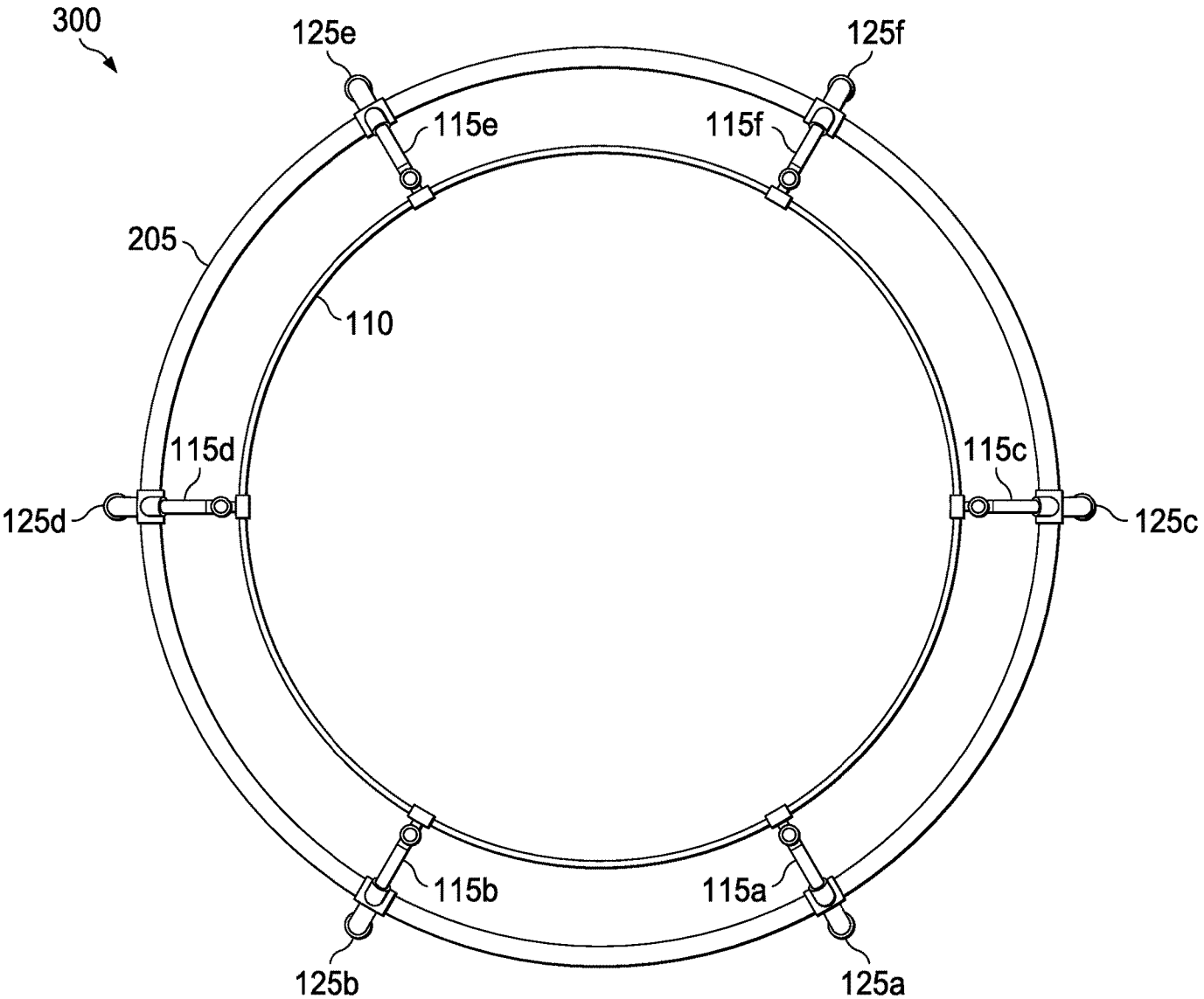
FIG. 3 illustrates a top view of an example trampoline frame in accordance with at least some embodiments.

Turning to FIG. 3, a top view 300 is shown of an example circular trampoline frame according to the principles discussed in the example of FIG. 2A. As noted above, a bottom ring frame section (e.g., 205) may be dimensioned to have a perimeter that is larger than and completely encloses the external perimeter of a handrail frame section (e.g., 110) connected to the bottom frame section by a set of upright support rods (e.g., 115*a-f*). The upright supports (e.g., 115*a-f*) may connect to the bottom ring frame section 205 before curving inward to connect to the handlebar frame section 110. In some cases, the upright supports may then again curve outward (e.g., above the connection with the handlebar 110) toward the perimeter formed by the bottom frame section 205. As further illustrated in the top view 300 of FIG. 3, leg sections (e.g., 125*a-f*) may connect to the bottom ring frame 205 and then extend outward beyond the exterior perimeter of the bottom ring frame to contact the ground and form a base wider than the bottom ring frame 205 and the jumping surface (not shown) supported by the bottom ring frame 205. In this example, the number of upright supports (e.g., 115*a-f*) corresponds to the number of legs sections (e.g., 125*a-f*) and a leg section and upright support each connect at the bottom ring frame 205 at substantially the same position on the ring. It should be appreciated that in other, alternative implementations, the number of legs (e.g., 125*a-f*) and upright supports (e.g., 115*a-f*) may not be equal and/or that legs (e.g., 125*a-f*) and upright supports (e.g., 115*a-f*) may connect at different locations on the bottom ring frame 205, among other example implementations.

Figure 4:
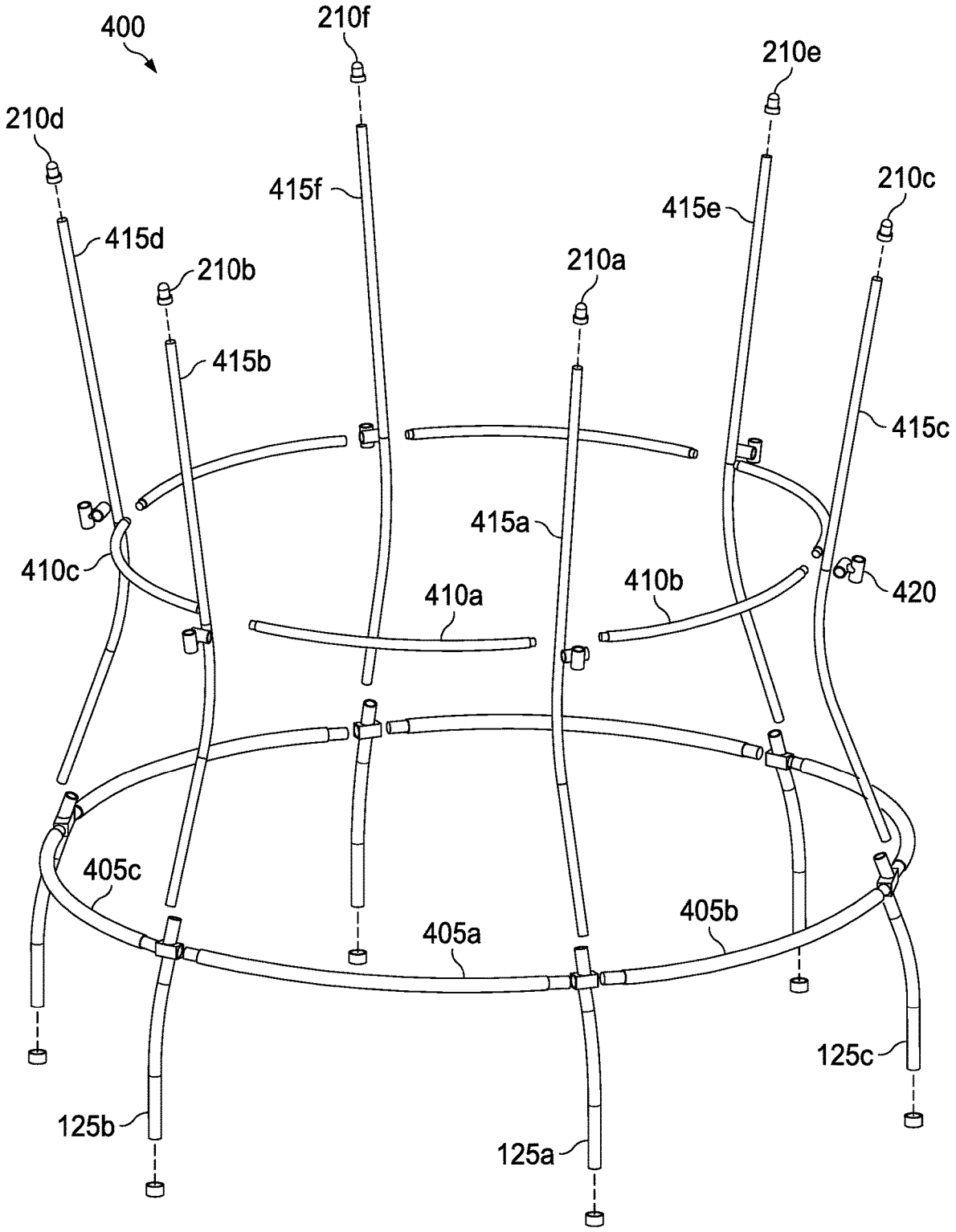
FIG. 4 illustrates example pieces for assembly of an example trampoline frame in accordance with at least some embodiments.

FIG. 4 shows an alternative view 400 of the frame illustrated in the example of FIG. 2A. The frame, in some implementations, may be assembled from a collection of frame pieces (i.e., rather than any one section or the entire frame, being pre-assembled as a unitary (e.g., permanently welded) piece). Handrail connectors (e.g., 420) and corresponding fasteners may be utilized to facilitate connections between the frame pieces to realize assembly of the entire frame (e.g., including the bottom ring frame, leg sections, upright support sections, handlebar section, etc.). In some implementations, assembly may be anticipated to be performed by vendors or purchasers who may possess little formal construction skills or experience. Connectors may be provided and the trampoline frame may be broken down into pieces in a manner that make assembly by laypersons intuitive and reasonable. In such implementations, by allowing the frame to be assembled from a collection of smaller pieces, the packaging utilized to transport and store instances of the frame (and trampolines including the frame) may thereby be reduced to a smaller footprint and/or volume without sacrificing the structural integrity of the frame upon assembly, among other example advantages. Accordingly, such a frame construction can assist in minimizing packaging, delivery, and storage costs. In one example, illustrated in FIG. 4, frame pieces may include multiple bottom ring frame sections (e.g., 405*a-c*), leg support pieces (e.g., 125*a-c*), handlebar pieces (e.g., 410*a-c*), upright support pieces (e.g., 415*a-f*), upright support connection cap pieces (e.g., 210*a-f*), and various connector elements (e.g., 420), which may be utilized to join various frame pieces during assembly of the frame in accordance with the principles and example advantages discussed above.

Figure 5:
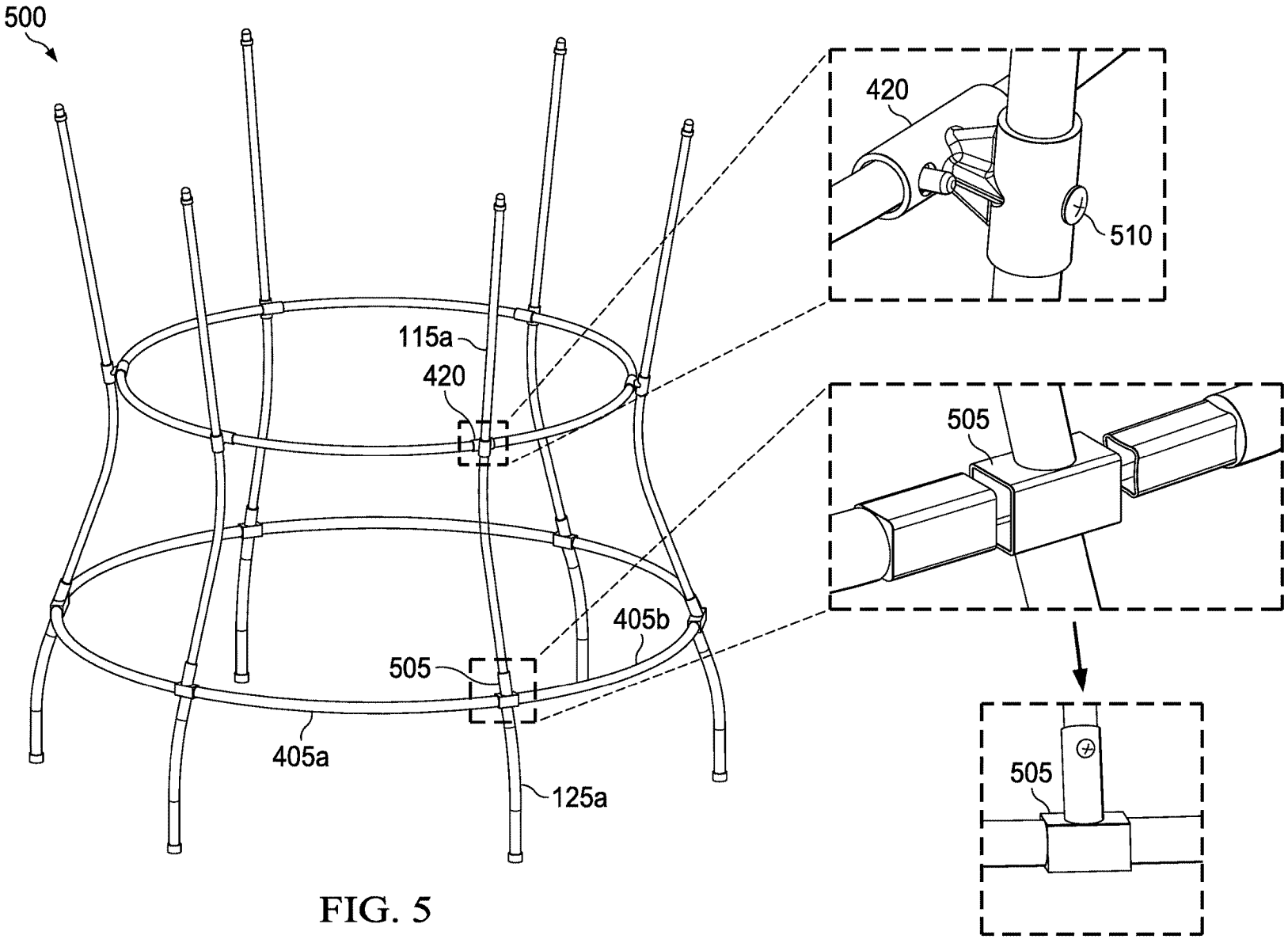
FIG. 5 illustrates example connectors for use in assembly of an example trampoline frame in accordance with at least some embodiments.

Turning to FIG. 5, a perspective view 500 of an example trampoline frame is provided, together with projected views showing details of example connectors (e.g., 420, 505), which may be incorporated in some implementations of a trampoline. For instance, a handrail connector 420 may be provided, which is configured to couple to a respective one of the upright supports (e.g., 115*a*) of the frame (e.g., using a screw (e.g., 510) or other fastener), pass through an opening in a flexible wall (not shown) to be attached to the upright supports (e.g., 115*a*), and connect to a handlebar 110 provided inside a jumping space (e.g., framed by a flexible perimeter wall). Bottom ring connectors (e.g., 505) may also be provided to connect leg sections (e.g., 125*a*) and upright supports (e.g., 115*a*) to a bottom ring frame section 205 of the example trampoline frame. In the example shown in FIG. 5, a bottom ring connector 505 may be integrated onto a leg section (e.g., 125*a*) and facilitate a connection between two pieces (e.g., 405*a*, 405*b*) of the bottom ring frame section 205, as well as one of the upright support frame sections (e.g., 115*a*). In some implementations, connectors according to the example handrail connector 420 and connectors according to the example bottom rail connector 505 may both be used in an example trampoline frame 500 (such as illustrated in FIG. 5). In other instances, only connectors according to example handrail connector 420 or bottom ring connectors 505 may be implemented (e.g., with other connections being facilitated through connectors of an alternative design or through permanent connections (e.g., welds)), among other example alternatives.

Figure 6:
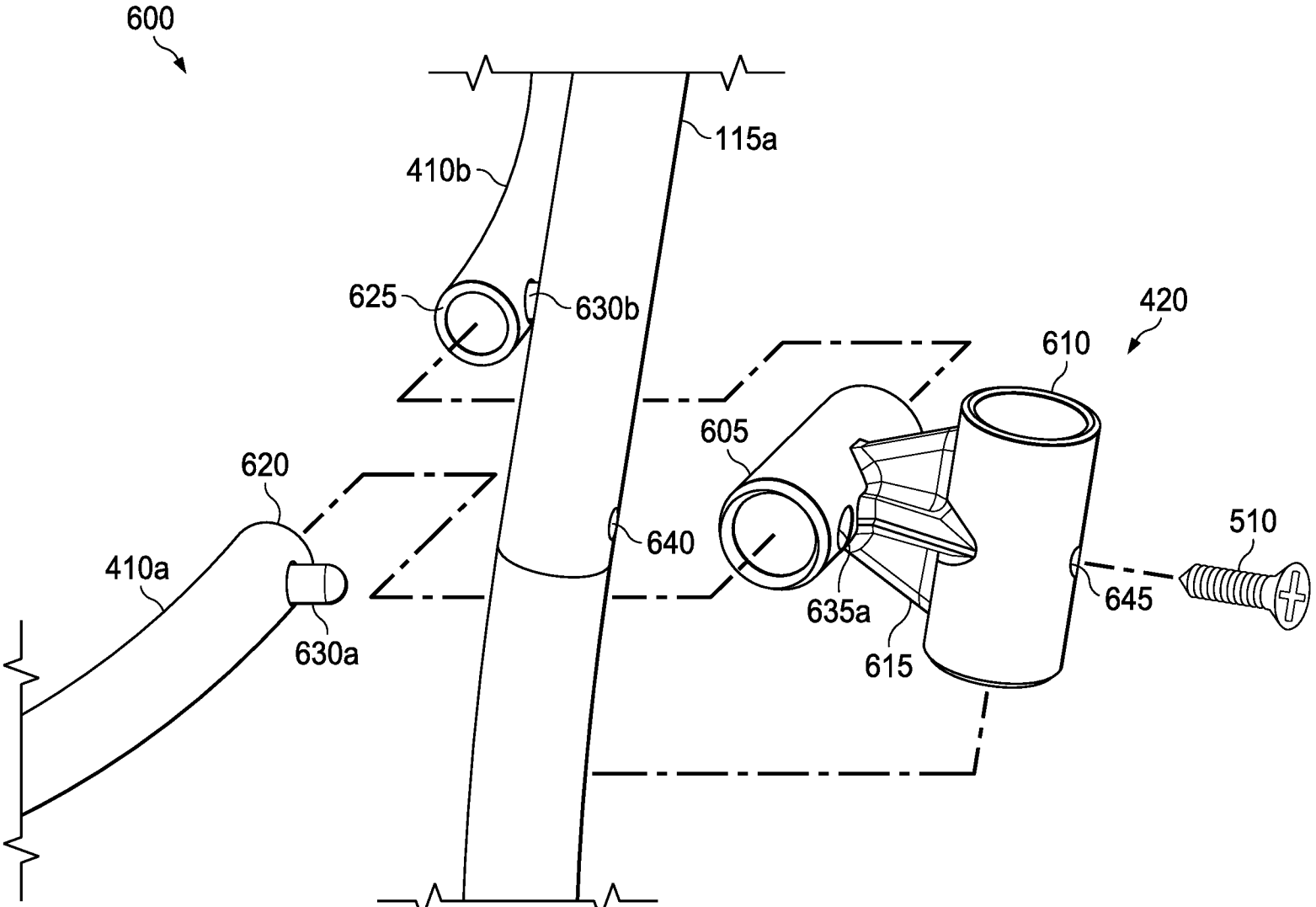
FIG. 6 illustrates a first view of an example handrail connector for a trampoline frame in accordance with at least some embodiments.

FIGS. 6-9 present various detailed views (e.g., 600, 700, 800, 900) of example implementations of a handrail connector 420 to connect a handrail to individual upright support elements of an example trampoline frame. For instance, FIG. 6 provides a detailed view of one example implementation of a handrail connector 420, as well as handlebar sections (e.g., 410*a*, 410*b*) and upright support sections (e.g., 115*a*) configured to connect through the example handrail connector 420. For instance, a handrail connector 420 may include a horizontal tube 605 and a vertical tube 610 coupled through a center member 615 integrally connected to both the horizontal tube 605 and vertical tube 610. In some cases, the handrail connector 420 may be a molded plastic or metal piece to integrally form horizontal tube 605, center member 615, and vertical tube 610 as a single piece. In other instances, the horizontal tube 605 and vertical tube 610 may be permanently welded to center member 615 to integrally connect the tubes sections 605, 610 to the center member, among other example construction techniques.

In one implementation, such as shown in FIG. 6, the horizontal tube 605 may include two openings, with each opening disposed to accept a respective handlebar end (e.g., 620, 625) of a handlebar section (e.g., 410*a*, 410*b*). In other implementations, the ends of the handlebar sections may be open and at least partially hollow to accept the ends of the horizontal tube 605 being inserted into the openings of the ends of corresponding handlebar sections (e.g., 410*a*, 410*b*). In the example of FIG. 6, spring-loaded push pin elements (e.g., 630*a*, 630*b*) may be provided near the ends (e.g., 620, 625) of each of the handlebar sections (e.g., 410*a*, 410*b*). A corresponding opening (e.g., 635*a*) may be provided near the openings of the horizontal tube 605 to allow the (e.g., spring-loaded) push pin elements (e.g., 630*a*, 630*b*) to pass through the openings (e.g., 635*a*) and releasably lock the corresponding handlebar piece (e.g., 410*a*, 410*b*) within the horizontal tube 605 of the handrail connector 420. The vertical tube 610 may be provided to facilitate the connection with an upright support (e.g., 115*a*) of the trampoline frame. In this example, an upright support (e.g., 115*a*) may be passed through the vertical tube 610, such that the vertical tube 610 encircles a portion of the upright support (e.g., 115*a*). Further, in some instances, the upright support (e.g., 115*a*) may be provided with a hole or indentation (e.g., 640) to at least partially accept a fastener, such as screw 510, used to fasten the vertical tube 610 to the upright support (e.g., 115*a*) (through a corresponding hole (e.g., 645) provided on the vertical tube member 610.

Figure 7:
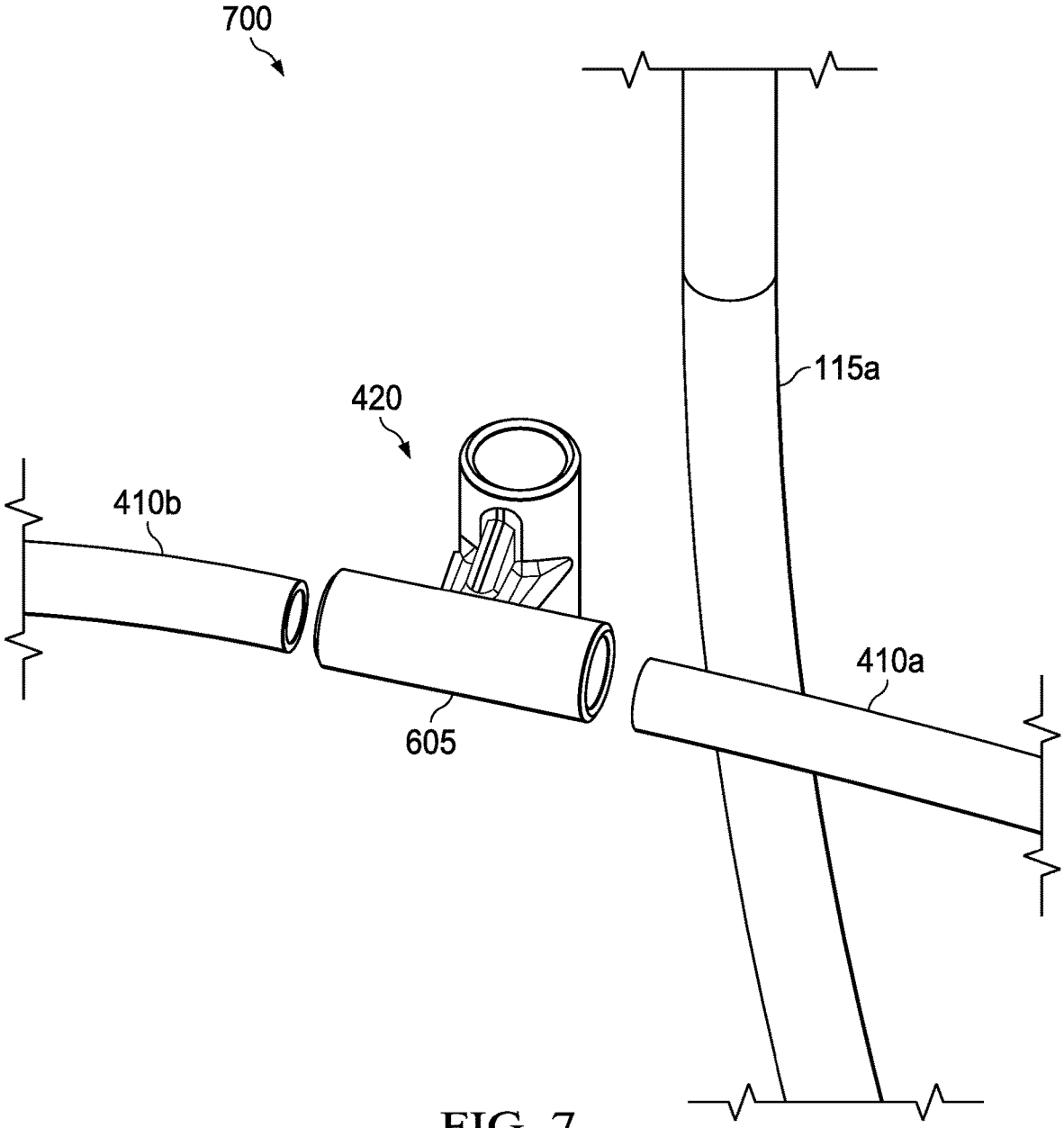
FIG. 7 illustrates a second view of an example handrail connector for a trampoline frame in accordance with at least some embodiments.
Figure 8:
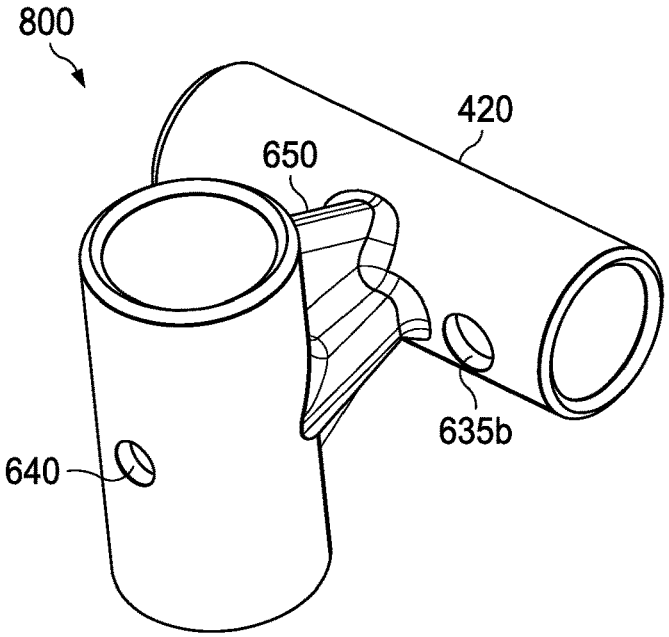
FIG. 8 illustrates a third view of an example handrail connector for a trampoline frame in accordance with at least some embodiments.
Figure 9:
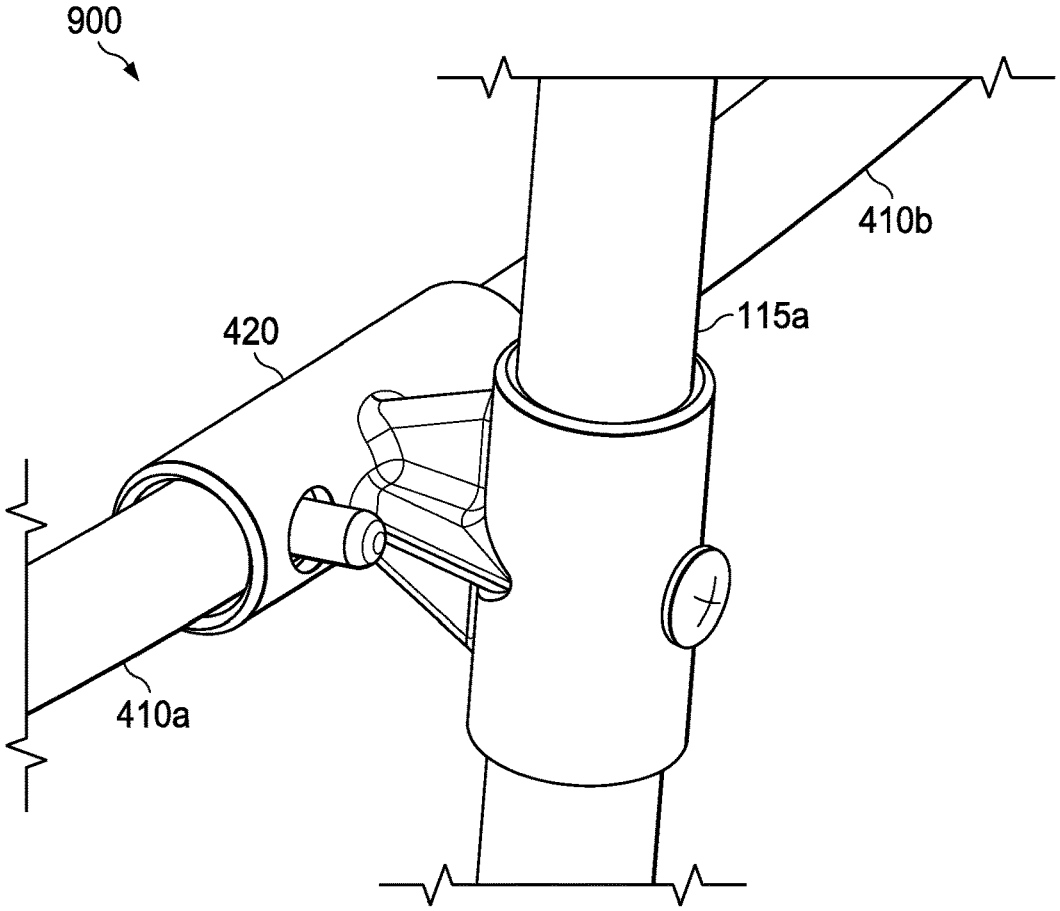
FIG. 9 illustrates a fourth view of an example handrail connector for a trampoline frame in accordance with at least some embodiments.

FIG. 7 shows a view 700 of an example handrail connector 420, showing the manner by which respective handrail pieces (e.g., 410*a*, 410*b*) may be joined to a horizontal tube member 605 of the handrail connector 420. FIG. 8 shows a standalone view 800 of an example handrail connector 420, illustrating openings 635*b*, 640, which may be provided through which push pins, screws, or other fasteners may be utilized to fasten the handrail connector 420 to upright support and handrail pieces of an example trampoline frame. FIG. 8 further shows that one or more ribs (e.g., 650) may be provided (e.g., on the center member of the handrail connector 420) to structurally reinforce the handrail connector 420. FIG. 9 illustrates a view 900 of the example handrail connector 420 connected and fastened to two handlebar pieces (e.g., 410*a*, 410*b*) and upright support 115*a*.

Figure 10:
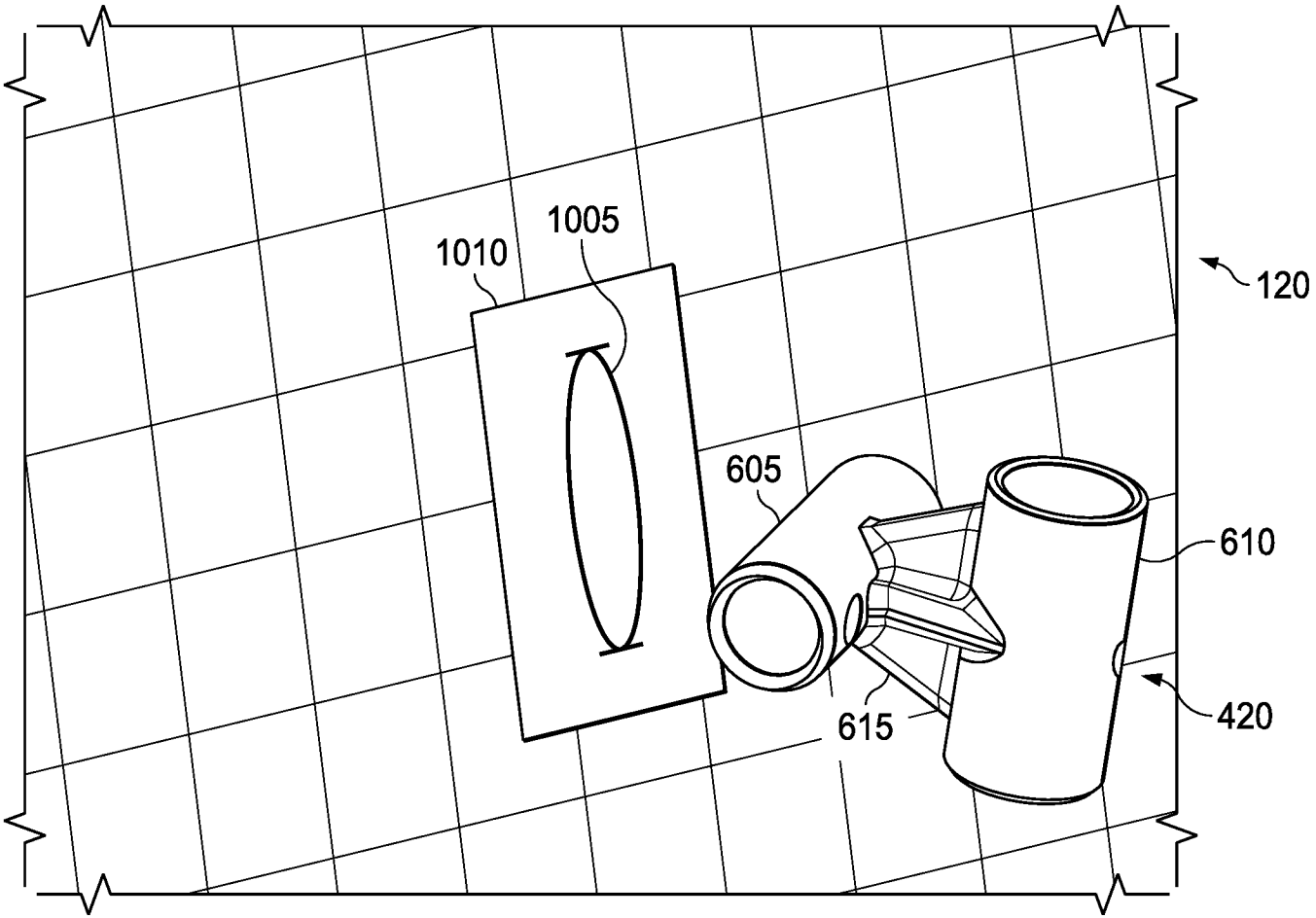
FIG. 10 illustrates passage of a portion of an example handrail connector through a flexible wall of a trampoline in accordance with at least some embodiments.

As noted above, an example handlebar may be provided within a jumping area framed or surrounded by a flexible wall attached to upright supports of the trampoline frame and protecting users from injury from falls from the jumping surface. In some instances, the handlebar may be provided within the jumping area (i.e., on one side of the flexible wall), while the upright supports are provided outside the jumping area (i.e., on other side of the flexible wall) to limit (through the flexible wall) jumpers' contact with the upright supports. As a consequence of such an arrangement, an example handrail connector 420 may be configured to pass through the flexible wall 120, with the length of the central member 615 forming a span that separates the horizontal tube member 605 from the vertical tube member 610. Further, as shown in the example of FIG. 10, in some implementations, an opening 1005 may be provided in the flexible wall 120 to enable the horizontal tube 605 to be passed through the flexible wall 120 (with the center member 615 resting within the opening 1005 upon passing half of the handrail connector 420 through the opening 1005 and completing assembly of the trampoline frame and the flexible wall 120). In this example, the connection of the handrail connector 420 to the handlebar pieces and/or the connection of the handrail connector 420 to a upright support are to be completed after passing one of the horizontal or vertical tube (e.g., 605, 610) through the opening 1005. In some cases, the opening 1005 may be a reinforced opening, such as through a patch 1010 of material more durable or rigid in quality than the materials of the flexible wall 120, with the opening 1005 cut through the patch 1010 and further reinforced with stitching, among other example implementations.

Figure 11:
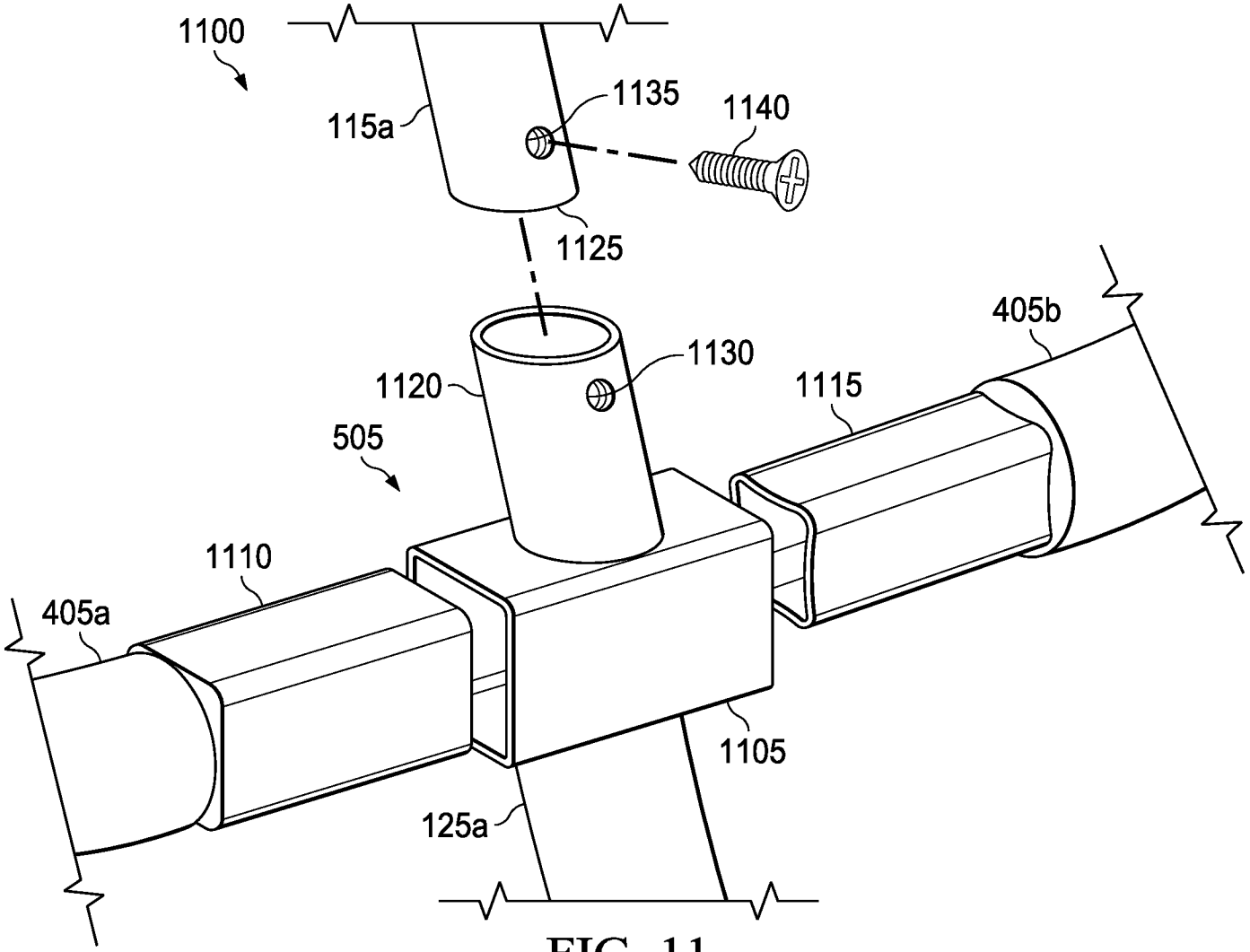
FIG. 11 illustrates a first view of an example ring frame connector for a trampoline in accordance with at least some embodiments.
Figure 12:
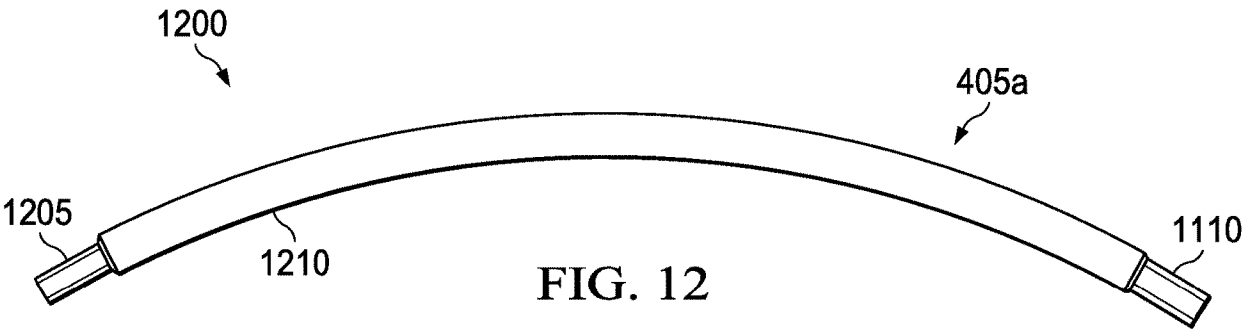
FIG. 12 illustrates an example ring frame piece of a trampoline frame in accordance with at least some embodiments.
Figure 13:
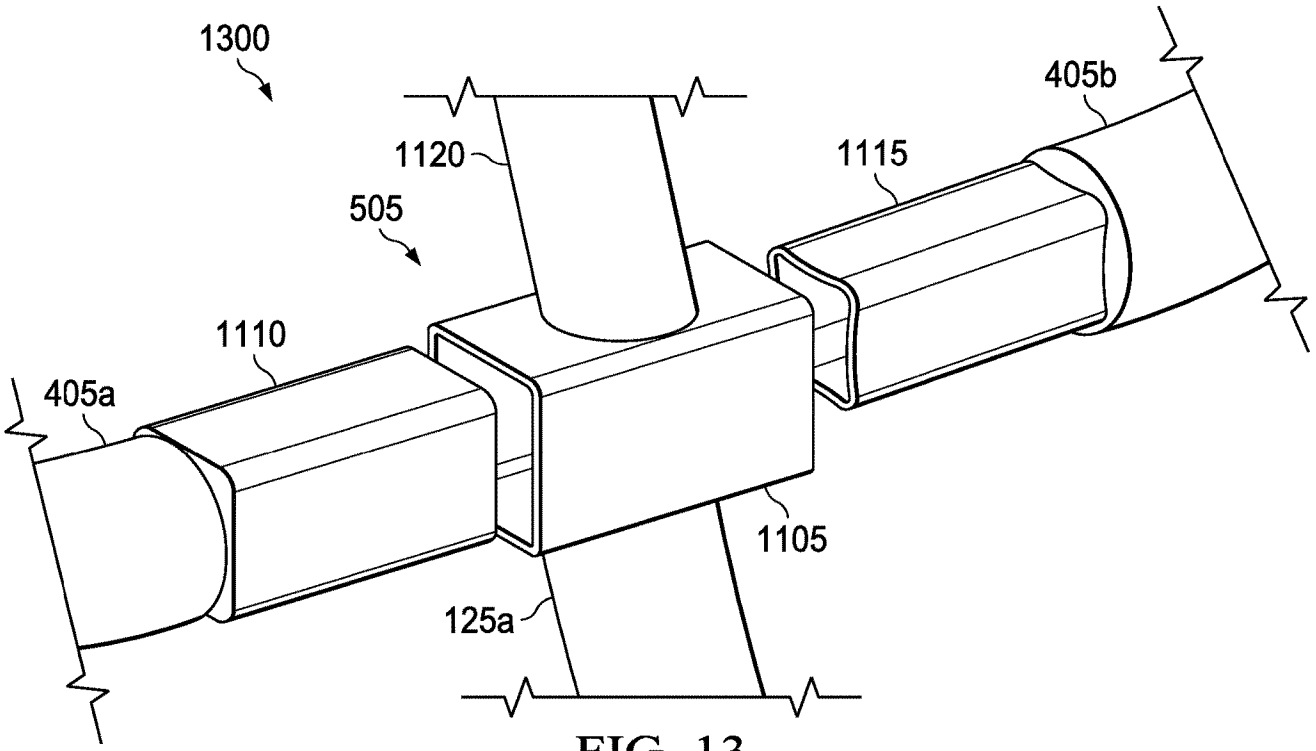
FIG. 13 illustrates a second view of an example ring frame connector for a trampoline in accordance with at least some embodiments.

Turning to FIGS. 11-13, views (e.g., 1100, 1200, 1300) are shown of an example bottom ring connector 505. In these examples, the bottom ring connector 505 is integrally coupled to a leg section (e.g., 125*a*), for instance, through a weld or by integrally forming the leg section 125*a* with the bottom ring connector 505, among other example construction techniques. In other instances, the bottom ring connector 505 may be provided as a separate piece (i.e., separate from the leg sections (e.g., 125*a*), upright support pieces (e.g., 415*a*), and bottom ring pieces (e.g., 405*a*, 405*b*), or integrally connected to an upright support piece (e.g., 415*a*) (i.e., rather than a leg), among other example implementations. As shown in the examples of FIGS. 11-13, in some implementations, a bottom ring connector 505 may incorporate a rectangular tube 1105 configured to accept two ends 1110, 1115 of two adjacent bottom ring pieces (e.g., 405*a*, 405*b*). Accordingly, the ends (e.g., 1110, 1115) of each bottom ring piece (e.g., 405*a*, 405*b*) may have a rectangular cross-section adapted to be inserted within the rectangular tube 1105 of the bottom ring connector 505. In alternative implementations, the rectangular tube 1105 may be proportioned to be inserted into a rectangular opening at each end of the bottom ring pieces (e.g., 405*a*, 405*b*) (i.e., rather than the ends of the bottom ring pieces (e.g., 405*a*, 405*b*) being inserted into the connector), among other example alternatives.

As shown in the examples of FIGS. 11-13, in some examples, a bottom ring connector 505 may also include an upper tube member 1120 configured to join with the bottom end 1125 of a piece of an upright support (e.g., 115*a*). For instance, the upper tube member 1120, in some implementations, may include an opening proportioned to accept the bottom ring end 1125 of an upright support 115*a*, with the bottom ring end 1125 being inserted into the opening of the upper tube member 1120. In other implementations, the upper tube member 1120 may be proportioned, instead, to be inserted into an opening at the end of the upright support 115*a*. In still other implementations, the bottom ring connector 505 may include a lower tube member (not shown) to couple to a leg section 125*a* (i.e., in implementations where the bottom ring connector 505 is separate from the leg sections (e.g., 125*a*), among other examples.

In the illustration of FIG. 11, the cross-sections of the upper tube member 1120 and end 1125 of the upright support 115*a* are each circular, however, other geometries may be adopted in other implementations (e.g., rectangular cross-sections). Further, in the particular example of FIG. 11, each of the upper tube member 1120 and upright support 115*a* may be provided with corresponding holes (e.g., 1130, 1135) to enable a screw 1140 to be used to secure the upright support (e.g., 115*a*) to the upper tube member 1120. In other implementations, other fasteners may be utilized (i.e., other than a screw) to fasten an upright support (e.g., 115*a*) to upper tube member 1120, such as through a spring pin, clamp, rivet, etc., and one or both of the upright support 115*a* and/or upper tube member 1120 may be configured to facilitate attachment through the fastener.

In some implementations, ends (e.g., 1110, 1115) of example bottom ring pieces (e.g., 405*a*, 405*b*) may be configured and sized such that one bottom ring piece end (e.g., 1115) fits and is nested within an opening of the other end (e.g., 1110), when both ends are inserted within the rectangular tube 1105 of the bottom ring connector (e.g., 505). By providing a rectangular tube and corresponding rectangular ends (e.g., 1110, 1115) of the bottom ring pieces (e.g., 405*a*, 405*b*), rotation of the bottom ring pieces is prevented, securing the structural stability of the assembled trampoline frame. In some implementations, the rectangular tube and end pieces may be sized such that the pieces fit snugly and are held together through friction forces, thereby allowing secure assembly of the bottom ring frame without the need of additional fasteners (although, in other implementations, fasteners may be additionally provided to secure the bottom ring piece ends (e.g., 1110, 1115) within the rectangular tube member 1105).

Turning to FIG. 12, an example bottom ring piece 405*a* is shown including two ends (e.g., 1110, 1205) that are rectangular (e.g., square) in cross-section. In this example, a portion 1210 of the bottom ring piece 405*a* may have a cross-section different from the ends 1110, 1205. For instance, portion 1210 may be an arced span with a circular cross-section or, alternatively, a rectangular cross-section (e.g., different than one or both of the rectangular cross-sections of ends 1110, 1205), among other example implementations. In the example of FIG. 12, end 1110 is larger in cross-section than end 1205, with end 1110 sized to fit within a rectangular tube member (e.g., 1105) of a bottom ring connector, and end 1205 sized to fit within a rectangular opening of the end 1110 of another, adjacent bottom ring piece (e.g., such as shown in the examples of FIGS. 11 and 13). The end of the other, adjacent bottom ring piece may be sized similar to the size and dimensions of end 1110. Indeed, end 1110 may include a similar rectangular opening such that the end 1110 both fits within the rectangular tube member 1105 of a bottom ring connector 505 and is capable of accepting, within its opening, the (smaller) rectangular end of another adjacent bottom ring piece (e.g., 405*b*), as shown, for instance, in the close-up view 1300 of FIG. 13. In this manner, at each rectangular tube member of each bottom ring connector (e.g., 505) of the trampoline frame, two rectangular ends (e.g., 1110, 1115) of two adjacent bottom ring pieces (e.g., 405*a*, 405*b*) may be inserted within the same rectangular tube member (e.g., 1105) of the corresponding bottom ring connector (e.g., 505), with a smaller of the two rectangular ends (e.g., 1115) inserted into and nested within an opening of the larger of the two rectangular ends (e.g., 1110) within the rectangular tube member (e.g., 1105), among other example implementations.

It should be appreciated that the particular examples illustrated and discussed above are provided merely to illustrate more general principles of this disclosure. Indeed, it should be appreciated that other features, changes, and alternative embodiments may be implemented without departing from the more general features proposed herein. Reference throughout this specification to "one implementation" or "an implementation" means that a particular feature, structure, or characteristic described in connection with the implementation is included in at least one implementation of the present disclosure. Thus, the appearances of the phrases "in one implementation," "in an implementation," "in one example," "in some examples," "in some instances," etc. in various places throughout this specification are not necessarily all referring to the same implementation. Furthermore, the particular features, structures, or characteristics may be combined in any suitable manner in one or more implementations.

The following examples pertain to embodiments in accordance with this disclosure. In accordance with some implementations, a trampoline frame includes a bottom ring frame to couple to a jumping surface, a plurality of legs coupled to the bottom ring to contact a ground surface and elevate the bottom ring frame above the ground surface, a plurality of curved upright supports to couple to the bottom ring frame and support a flexible wall to form an at least partial perimeter around the jumping surface, and a handrail coupled to the plurality of upright supports and positioned above the bottom ring frame. Each of the plurality of legs may include a respective connecting end to couple to the bottom ring frame and a respective foot to contact the ground surface, and each of the plurality of legs may be curved to place the corresponding foot outside an external perimeter of the bottom ring frame when connected to the bottom ring frame. Each of the plurality of curved upright supports may be curved inward toward a center of the jumping surface to connect to the handrail.

In some instances, an apparatus may further include the jumping surface, spring members to couple the jumping surface to the bottom ring frame, and the flexible wall. A plurality of handrail connectors may be corresponding to the plurality of upright supports, where each of the plurality of handrail connectors includes a first member to couple to the corresponding one of the plurality of upright supports, and a second member to couple to the handrail. The first member may include a vertical tube, at least a portion of the corresponding upright support is to be inserted into the vertical tube, the second member includes a horizontal tube, and at least a portion of the handrail is to be inserted into the horizontal tube. The handrail may include a plurality of handrail pieces, each horizontal tube including a respective first opening and a respective second opening, each horizontal tube to be connected to ends of two respective handrail pieces in the plurality of handrail pieces, the first opening to accept an end of a first one of the two respective handrail pieces, and the second opening to accept an end of a second one of the two respective handrail pieces. Each of the plurality of handrail connectors may include a center member to integrally couple the first member to the second member and separate the first member from the second member by a length.

In some instances, the bottom ring frame may include a plurality of ring pieces, each of the plurality of leg includes a respective bottom ring connector, each of the bottom ring connectors includes a rectangular tube member, each of the plurality of ring pieces includes respective ends with rectangular cross-sections, and the rectangular tube member may be configured to accept the ends of two of the plurality of ring pieces. The ends each of the ring pieces may include a respective first end and a respective second end, the first end larger than the second end and including a rectangular opening sized to accept the second end of another bottom ring piece, where, when the two ring pieces are inserted in the rectangular tube member, and the second end of one of the two ring pieces is inserted in the opening of the first end of the other of the two ring pieces. A portion of each of the ring pieces between the ends may have a circular cross-section. One or more of the bottom ring connectors may further include an upper member integrally connected to the remaining bottom ring connector and configured to couple to at least a portion of one of the plurality of upright supports. A trampoline frame may include both the bottom ring connectors and the handrail connectors as described.

In some aspects, the bottom ring frame is a circular ring frame, the jumping surface is a circular jumping surface, and the handrail is a circular handrail, where the diameter of the handrail is smaller than the diameter of the bottom ring frame. In other instances, the bottom ring frame is a rectangular ring frame, the jumping surface is a rectangular jumping surface, and the handrail is a rectangular handrail, where length and width of the handrail are each smaller than the length and width of the ring frame.

In some implementations, a method or process of assembling a trampoline may include assembling a bottom ring frame, attaching a plurality of upright supports to the bottom ring frame, and attaching a handrail to each of the upright supports using a plurality of handrail connectors. Assembling the bottom ring frame may include connecting each of a plurality of bottom ring pieces to a plurality of ring connectors, where each of the ring connectors includes a respective rectangular tube member, each of the plurality of bottom ring pieces includes respective ends with rectangular cross-sections, and connecting the bottom ring pieces to the plurality of bottom ring connectors includes inserting a respective end of each of two of the plurality of bottom ring pieces in the respective rectangular tube member of one of the plurality of bottom ring connectors. The handrail may include a plurality of handrail pieces, each of the plurality of handrail connectors includes a respective vertical tube member and a respective horizontal tube member, and attaching the handrail to each of the upright support includes connecting the upright support to the vertical tube member of the corresponding handrail connector, and connecting ends of two of the plurality of handrail pieces to the horizontal tube member.

In some aspects, each of the plurality of ring connectors is integrally connected to a respective one of a plurality of leg pieces, and connecting the ring pieces to the plurality of ring connectors connects the plurality of leg pieces to the bottom ring frame. Each of the plurality of ring connectors may further include an upright connection member, and attaching the plurality of upright ring supports to the bottom ring frame may include connecting each of the upright supports to the upright connection member of a respective one of the plurality of ring connectors. Assembling the trampoline may further include attaching a flexible wall to the plurality of upright supports, where the flexible wall includes a plurality of side openings, and attaching the handrail includes passing the horizontal tube member of each of the plurality of handrail connectors through a respective one of the plurality of side openings before connecting one of: the ends of the two handrail pieces to the corresponding horizontal tube member or the upright support to the corresponding vertical tube member.

In some implementations, a trampoline is provided that includes a jumping surface, a flexible wall to attach to the jumping surface, and a frame. The frame may include a bottom ring frame to couple to the jumping surface, a plurality of legs coupled to the bottom ring to contact a ground surface and elevate the bottom ring frame above the ground surface, a plurality of curved upright supports to couple to the bottom ring frame and support the flexible wall, and a handrail coupled to the plurality of upright supports and positioned above the bottom ring frame. Each of the plurality of legs may include a respective foot to contact the ground surface, and each of the plurality of legs is curved to place the corresponding foot outside an external perimeter of the bottom ring frame when the leg is connected to the bottom ring frame. Each of the plurality of curved upright supports may be curved inward toward a center of the jumping surface to connect to the handrail. The trampoline, as a result, may have an hourglass-like shape due to these inward curves (and an upper portion of the upright support flaring back outward above the curve). The bottom ring connectors and handrail connectors discussed above may also be utilized to facilitate the trampoline frame, such as discussed above. In some instances, the trampoline may be dimensioned to support only a single user at a time, users of different sizes or ages, among other example features and embodiments, as well as combinations and subcombinations of the foregoing, as both explicitly and implicitly shown and described herein.

Thus, particular embodiments of the subject matter have been described. Other embodiments are within the scope of the following claims. In some cases, the features, components, and actions recited in the claims can be arranged or performed in a different manner and still achieve desirable results. In addition, the processes depicted in the accompanying figures do not necessarily require the particular order shown, or sequential order, to achieve desirable results.

A detailed description has been given with reference to specific exemplary embodiments. It will, however, be evident that various modifications and changes may be made thereto without departing from the broader spirit and scope of the invention as set forth in the appended claims. The specification and drawings are, accordingly, to be regarded in an illustrative sense rather than a restrictive sense. Furthermore, the foregoing use of embodiment and other exemplarily language does not necessarily refer to the same embodiment or the same example, but may refer to different and distinct embodiments, as well as potentially the same embodiment.

The invention claimed is:

1. An apparatus comprising:

a trampoline frame comprising:

a bottom ring frame to couple to a jumping surface;

a plurality of legs coupled to the bottom ring to contact a ground surface and elevate the bottom ring frame above the ground surface;

a plurality of curved upright supports to couple to the bottom ring frame and support a flexible wall to form an at least partial perimeter around the jumping surface with the flexible wall; and a handrail coupled to the plurality of upright supports and positioned above the bottom ring frame and below a top end of at least one of plurality of upright supports, wherein each of the plurality of legs comprises a respective connecting end to couple to the bottom ring frame and a respective foot to contact the ground surface, and each of the plurality of legs is curved to place the corresponding foot outside an external perimeter of the bottom ring frame when connected to the bottom ring frame, and wherein each of the plurality of curved upright supports is curved inward toward a center of the jumping surface to connect to the handrail via a respective handrail connector, wherein the handrail connectors position the handrail inside the perimeter formed by the flexible wall to allow a gap between the flexible wall and at least a portion of the handrail.

2. The apparatus of claim 1, further comprising:
the jumping surface;
spring members to couple the jumping surface to the bottom ring frame; and
the flexible wall.

3. The apparatus of claim 1, wherein each of the handrail connectors corresponding to the plurality of upright supports comprises:
a first member to couple to the corresponding one of the plurality of upright supports; and
a second member to couple to the handrail.

4. The apparatus of claim 3, wherein the first member comprises a vertical tube, at least a portion of the corresponding upright support is to be inserted into the vertical tube, the second member comprises a horizontal tube, and at least a portion of the handrail is to be inserted into the horizontal tube.

5. The apparatus of claim 4, wherein the handrail comprises a plurality of handrail pieces, each horizontal tube comprises a respective first opening and a respective second opening, each horizontal tube is to be connected to ends of two respective handrail pieces in the plurality of handrail pieces, the first opening is to accept an end of a first one of the two respective handrail pieces, and the second opening is to accept an end of a second one of the two respective handrail pieces.

6. The apparatus of claim 3, wherein each of the plurality of handrail connectors comprises a center member to integrally couple the first member to the second member and separate the first member from the second member by a length.

7. The apparatus of claim 1, wherein the bottom ring frame comprises a plurality of ring pieces, each of the plurality of legs comprises a respective bottom ring connector, each of the bottom ring connectors comprises a rectangular tube member, each of the plurality of ring pieces comprises respective ends with rectangular cross-sections, and the rectangular tube member is configured to accept the ends of two of the plurality of ring pieces.

8. The apparatus of claim 7, wherein the ends of each of the ring pieces comprises a respective first end and a respective second end, the first end is larger than the second end and comprises a rectangular opening sized to accept the second end of another bottom ring piece, wherein, when the two ring pieces are inserted in the rectangular tube member, the second end of one of the two ring pieces is inserted in the opening of the first end of the other of the two ring pieces.

9. The apparatus of claim 7, wherein a portion of each of the ring pieces between the ends has a circular cross-section.

10. The apparatus of claim 7, wherein one or more of the bottom ring connectors further comprises an upper member integrally connected to the remaining bottom ring connector and configured to couple to at least a portion of one of the plurality of upright supports.

11. The apparatus of claim 7, further comprising a plurality of handrail connectors corresponding to the plurality of upright supports, wherein each of the plurality of handrail connectors comprises:
a vertical tube member to couple to the corresponding one of the plurality of upright supports; and
a horizontal tube member to couple to the handrail.

12. The apparatus of claim 1, wherein the bottom ring frame comprises a circular ring frame, the jumping surface comprises a circular jumping surface, and the handrail comprises a circular handrail, wherein the diameter of the handrail is smaller than the diameter of the ring frame.

13. A method for assembling a trampoline, the method comprising:
assembling a bottom ring frame, wherein assembling the bottom ring frame comprises connecting each of a plurality of ring pieces to a plurality of ring connectors, wherein each of the ring connectors comprises a respective rectangular tube member, each of the plurality of ring pieces comprises respective ends with rectangular cross-sections, and connecting the ring pieces to the plurality of ring connectors comprises inserting a respective end of each of two of the plurality of ring pieces in the respective rectangular tube member of one of the plurality of ring connectors;
attaching a plurality of upright supports to the bottom ring frame; and
attaching a handrail to each of the upright supports using a plurality of handrail connectors, wherein the handrail comprises a plurality of handrail pieces, each of the plurality of handrail connectors comprises a respective vertical tube member and a respective horizontal tube member, and attaching the handrail to each of the upright support comprises:
connecting the upright support to the vertical tube member of the corresponding handrail connector, wherein the vertical tube member connects to the upright support between a bottom and top end of the upright support; and
connecting ends of two of the plurality of handrail pieces to the horizontal tube member.

14. The method of claim 13, wherein each of the plurality of ring connectors is integrally connected to a respective one of a plurality of leg pieces, and connecting the ring pieces to the plurality of ring connectors connects the plurality of leg pieces to the bottom ring frame.

15. The method of claim 13, wherein each of the plurality of ring connectors further comprises an upright connection member, and attaching the plurality of upright ring supports to the bottom ring frame comprises connecting each of the upright supports to the upright connection member of a respective one of the plurality of ring connectors.

16. The method of claim 13, further comprising attaching a flexible wall to the plurality of upright supports, wherein the flexible wall comprises a plurality of side openings, and attaching the handrail comprises passing the horizontal tube member of each of the plurality of handrail connectors through a respective one of the plurality of side openings before connecting one of: the ends of the two handrail pieces to the corresponding horizontal tube member or the upright support to the corresponding vertical tube member.

17. A trampoline comprising:
a jumping surface;
a flexible wall to attach to the jumping surface; and
a frame comprising:
a bottom ring frame to couple to the jumping surface;
a plurality of legs coupled to the bottom ring to contact a ground surface and elevate the bottom ring frame above the ground surface;
a plurality of curved upright supports to couple to the bottom ring frame and support the flexible wall; and
a handrail coupled to the plurality of upright supports, wherein the handrail is positioned above the bottom ring frame and below a top of the flexible wall,
wherein each of the plurality of legs comprises a respective foot to contact the ground surface, and each of the plurality of legs is curved to place the corresponding foot outside an external perimeter of the bottom ring frame when the leg is connected to the bottom ring frame, and wherein each of the plurality of curved upright supports is curved inward toward a center of the jumping surface to connect to the handrail to position the handrail within the external perimeter formed by the flexible wall, wherein the handrail is positioned within the external perimeter such that a gap is maintained between the flexible wall and at least a portion of the handrail.

18. The trampoline of claim 17, wherein the trampoline is dimensioned to support a single user at a time.

* * * * *